United States Patent [19]

Kolbe et al.

[11] 4,446,034

[45] May 1, 1984

[54] TEXTILE-TREATMENT AGENTS, AND THEIR USE FOR FINISHING TEXTILE MATERIALS

[75] Inventors: Joachim Kolbe, Leverkusen; Wilfried Kortmann, Hohenlimburg; Josef Pfeiffer, Leverkusen, all of Fed. Rep. of Germany

[73] Assignee: Bayer Aktiengesellschaft, Leverkusen, Fed. Rep. of Germany

[21] Appl. No.: 415,866

[22] Filed: Sep. 8, 1982

[30] Foreign Application Priority Data

Sep. 25, 1981 [DE] Fed. Rep. of Germany ..... 3138181

[51] Int. Cl.[3] ..... D06M 13/46; D06M 13/40

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 3,223,545 | 12/1965 | Gallaugher et al. | 252/8.8 |
| 3,451,927 | 6/1969 | Tune | 252/8.8 |
| 3,652,419 | 3/1972 | Karg | 252/8.8 |

FOREIGN PATENT DOCUMENTS

| | | | |
|---|---|---|---|
| 154712 | 4/1982 | Fed. Rep. of Germany | 252/8.8 |
| 53-94694 | 8/1978 | Japan | 252/8.8 |
| 2053249 | 2/1981 | United Kingdom | 252/8.8 |

*Primary Examiner*—Maria Parrish Tungol

*Attorney, Agent, or Firm*—Sprung, Horn, Kramer & Woods

[57] ABSTRACT

Textile-treatment agents which contain

A. 50–80% by weight of acylated alkanolamines formed from saturated or unsaturated fatty acids having 12–22 C atoms and alkanolamines containing 1 or 2 nitrogen atoms, 1–3 hydroxyl groups and 2–6 C atoms, in a molar ratio of 1:1 to 3:1, B. 10–30% by weight of water-soluble quaternary ammonium salts of the general formula

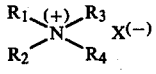

wherein $R_1$ denotes an alkyl or alkenyl radical having 14–25 C atoms which is interrupted by an amide or ester groups, $R_2$ denotes a radical such as $R_1$ or an alkyl radical having 1–4 C atoms, $R_3$ denotes an alkyl radical having 1–4 C atoms or an hydroxyethyl or hydroxypropyl radical, $R_4$ denotes an alkyl radical having 1–4 C atoms or an hydroxyethyl, hydroxypropyl or benzyl radical and $X^{(-)}$ denotes an anion.

C. 2–20% by weight of a fatty acid ester formed from saturated or unsaturated fatty acids having 12–22 C atoms or dicarboxylic acids having 4–10 C atoms and monohydric to tetrahydric alcohols having 3–20 C atoms, D. 0–20% by weight of ethylene oxide adducts formed from fatty acids having 12–22 C atoms or from fatty alcohols having 8–18 C atoms or from alkylamines or dialkylamines having 12–36 C atoms or from alkylphenols having 10–24 C atoms and 3 to 50 mols of ethylene oxide and E. 0–25% by weight of diorganopolysiloxanes having a viscosity of 1,000 to 100,000 cSt, and a process for finishing natural and synthetic textile materials, characterized in that they are treated with these textile-treatment agents.

5 Claims, No Drawings

TEXTILE-TREATMENT AGENTS, AND THEIR USE FOR FINISHING TEXTILE MATERIALS

The invention relates to textile-treatment agents which contain

A. 50–80% by weight of acylated alkanolamines formed from saturated or unsaturated fatty acids having 12–22 C atoms and alkanolamines containing 1 or 2 nitrogen atoms, 1–3 hydroxyl groups and 2–6 C atoms, in a molar ratio of 1:1 to 3:1, B. 10–30% by weight of water-soluble quaternary ammonium salts of the general formula

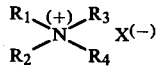

wherein $R_1$ denotes an alkyl or alkenyl radical having 14–25 C atoms which is interrupted by an amide or ester groups, $R_2$ denotes a radical such as $R_1$ or an alkyl radical having 1–4 C atoms, $R_3$ denotes an alkyl radical having 1–4 C atoms or an hydroxyethyl or hydroxypropyl radical, $R_4$ denotes an alkyl radical having 1–4 C atoms or an hydroxyethyl, hydroxypropyl or benzyl radical and $X^{(-)}$ denotes an anion.

C. 2–20% by weight of a fatty acid ester formed from saturated or unsaturated fatty acids having 12–22 C atoms or dicarboxylic acids having 4–10 C atoms and monohydric to tetrahydric alcohols having 3–20 C atoms, D. 0–20% by weight of ethylene oxide adducts formed from fatty acids having 12–22 C atoms or from fatty alcohols having 8–18 C atoms or from alkylamines or dialkylamines having 12–36 C atoms or from alkylphenols having 10–24 C atoms and 3 to 50 mols of ethylene oxide and E. 0–25% by weight of diorganopolysiloxanes having a viscosity of 1,000 to 100,000 cSt, and a process for finishing synthetic or natural textile materials, or their mixtures, with these agents.

The acylated alkanolamines, A, which have been described, for example in K. Lindner "Tenside-Textilhilfsmittel-Waschrohstoffe (Surfactants—Textile Auxiliaries—Detergent Raw Materials)", 2nd edition, volume 1, pages 904 and 993, and in Schwartz-Perry "Surface Active Agents" 1949, volume 1, page 173, contain, depending on the alkanolamines used, amide and/or ester groups.

For the preparation of these acylated alkanolamines, use is made of carboxylic acids of natural or synthetic origin, for example lauric acid, myristic acid, palmitic acid, stearic acid, behenic acid or oleic acid, or their mixtures as prepared, for example, from coconut oil, palm oil or tallow, or of branched acids from the oxo synthesis, for example isostearic acid, or acid chlorides thereof. Preferably, stearic acid and behenic acid are used in the form of their technical grades.

Suitable amines containing hydroxyl groups include monoethanolamine, diethanolamine, triethanolamine, N-methyldiethanolamine, N-(2-aminoethyl)-ethanolamine, 1-aminopropanol and bis-(2-hydroxypropyl)-amine. N-(2-Aminoethyl)-ethanolamine, monoethanolamine or diethanolamine are preferably used.

The water-soluble quaternary ammonium salts B contain, as a hydrophobic radical, at least one alkyl chain interrupted by an amide or ester group. To prepare these ammonium salts, mono-, di- or triamines which contain one tertiary amino group and one or two primary amino groups and one or two hydroxyl groups are acylated by known methods, as described, for example, in Schwartz-Perry "Surface Active Agents", 1949, volume 1, page 118, and in Jügermann "Cationic Surfactants" 1970, page 29, with acids mentioned under A.

$R_1$ preferably represents the radical $$R_5—CO—Y—R_6—$$

in which $R_5$ denotes an alkyl or alkenyl radical having 12 to 22 C atoms, $R_6$ denotes ethylene or propylene and Y denotes NH or O.

$X^{(-)}$ preferably represents chloride, bromide, sulphate, phosphate, methosulphate or dimethyl phosphite.

Examples of amines suitable for preparing B are 3-amino-1-dimethylaminopropane, 3-amino-1-diethylaminopropane, methyl-bis-(3-aminopropyl)-amine, bis-(2-methylaminoethyl)-methylamine, 2-dimethylaminoethanol, methyl-bis-(2-hydroxyethyl)-amine and 3-dimethylamino-1-propanol.

Preferabled compounds B are products from reacting technical stearic acid or behenic acid with 3-amino-1-dimethylaminopropane or 3-amino-1-diethylaminopropane and which are quaternised with dimethyl sulphate or dimethyl phosphite.

Quaternisation is carried out by customary methods without solvents or in a solvent, which, apart from water or ethyl alcohol, can also be acylated alkanolamines A in molten form, provided they do not contain a tertiary nitrogen atom.

Suitable quaternising agents are methyl chloride, dimethyl sulphate, dimethyl phosphite or ethylene oxide, in the latter case the reaction being carried out in a solution containing sulphuric acid or phosphoric acid.

The substances of the two groups of materials A and B can also be prepared in a one-vessel process, by reacting mixtures of the amines mentioned for both the groups with fatty acids and then quaternising in a corresponding manner that content of tertiary amino groups.

To prepare the carboxylates C, mono- to tetrahydric alcohols having 3–20 C atoms and the alkyl chains of which can be interrupted by oxygen are preferably used.

Examples which may be mentioned of esters C are butyl stearate, 2-ethylhexyl stearate, octadecyl stearate, isotridecyl stearate, 2-ethylhexyl oleate, di-2-ethylhexyl sebacate, pentaethylene glycol dilaurate, trimethylolpropane trilaurate and pentaerythritol tetrapelargonate.

To improve the solubility, ethylene oxide adducts of fatty acids, fatty alcohols, fatty amines or alkylphenols can be used if appropriate. The optimum degree of oxyethylation varies from case to case and can be 3–50 mols of ethylene oxide per mol of starting substance.

If desired, aqueous emulsions of dimethylpolysiloxanes prepared by emulsion polymerisation and having mean molecular weights of 1,000 to 100,000, can be used.

The compositions according to the invention can additionally also contain yet other constituents as customary for textile auxiliaries. These constituents include protective colloids, perfumes, fungicides, or bactericides and antifoam agents.

To improve ease of practical handling, the mixtures according to the invention are converted into aqueous formulations. For this purpose, the mixtures are heated to above the melting point and stirred with stirring after adding the corresponding amount of warm water until homogeneous. After cooling-down to room temperature, liquid, stable solutions or emulsions are obtained which preferably contain 10–30% by weight of the textile-treatment agent according to the invention.

The mixtures can be applied to textile material by known methods, namely by exhaustion methods (winch or jet-dyeing unit), by paddling or by spraying. It is considered a particular advantage that the textile-treatment agents according to the invention can be applied by means of jet-dyeing units.

Textile processing steps such as sewing or tufting place high demands on the textile material in respect of surface smoothness. High needle speeds place the material being sewed under thermal and mechanical stresses which, if surface smoothness is deficient, can lead to broken ends and burst loops. This disadvantage can be overcome by providing the textile material with a smoothing processing finish. It is known to use, for this purpose, emulsions or dispersions of paraffin hydrocarbons or of waxes. Thus, for example, German Offenlegungsschriften Nos. 2,621,881, 2,733,493, 2,816,196 and 2,830,173 describe cationic emulsions of paraffin hydrocarbons in which cationic surfactants are used as emulsifiers. German Offenlegungsschrift No. 3,003,851 describes dispersions of oxidised waxes, while German Offenlegungsschrift No. 2,535,768 uses dispersions of polysiloxanes and hydrocarbons or fluorine-containing polymers to achieve high surface smoothness values. It is also known to use, together with paraffin hydrocarbons, fatty acid esters as lubricants.

Although these emulsions impart high surface smoothness to textile materials, in most cases the result is that the material has a handle which requires the additional use of a textile softener. Moreover, these emulsions or dispersions frequently have the disadvantage that they are not suitable for use in jet-dyeing units operating with short liquors, since the high shear forces due to the process destroy the emulsions. This causes creaming and spotting as well as unlevel distribution of the processing finish on the textile material. The present invention now provides processing finishes which, in addition to high surface smoothness, impart to the textile material a pleasant handle and which have a liquor stability which is such that they can be used in jet-dyeing units.

It has now been found, surprisingly, that the agents according to the invention, without using paraffins or waxes, are excellent softeners and smoothing agents for textile materials of any type.

EXAMPLES

Table 1 shows the molar quantities of components used for preparing acylated alkanolamines A and the acid numbers as obtained after the reaction under reduced pressure and at elevated temperature.

TABLE 1

| Components | A 1 | A 2 | A 3 | A 4 |
|---|---|---|---|---|
| Technical stearic acid | 1.8 | 1.0 | 2.0 | 1.0 |
| Technical behenic acid | | 0.8 | | |
| N—(2-Aminoethyl)-ethanolamine | 1.0 | 1.0 | | |
| Diethanolamine | | | 1.0 | |
| Monoethanolamine | | | | 1.0 |
| Acid number | 2.1 | 2.8 | 0.9 | 5.4 |

Table 2 shows the molar ratio in which the individual components were reacted to prepare the basic fatty acid amides or fatty acid esters which serve as starting products for preparing the quaternary ammonium salts. The bottom line indicates the acid numbers obtained in the reaction of the components at an elevated temperature and under reduced pressure.

TABLE 2

| Components | B 1 | B 2 | B 3 | B 4 | B 5 |
|---|---|---|---|---|---|
| Technical stearic acid | 1.0 | 2.0 | 2.0 | | 0.5 |
| Technical behenic acid | | | | 1.0 | 0.5 |
| 3-Amino-1-dimethylamino-propane | 1.0 | | | 1.0 | 1.0 |
| bis-(2-Methylaminoethyl)-methylamine | | 1.0 | | | |
| Methyl-bis-(2-hydroxyethyl)-amine | | | | 1.0 | |
| Acid number | 0.9 | 1.7 | 1.9 | 1.3 | 1.8 |

Table 3 provides a survey of the preparation of the quaternary ammonium salts used.

TABLE 3

| Starting product | B 1 Q | B 2 Q | B 3 Q | B 4 Q | B 5 Q |
|---|---|---|---|---|---|
| B 1 | DMS | | | | |
| B 2 | | EO/$H_2SO_4$ | | | |
| B 3 | | | M | | |
| B 4 | | | | DMP | |
| B 5 | | | | | DMS |

The following abbreviations for quaternising agents are used in the table:

DMS: dimethyl sulphate(1)

DMP: dimethyl phosphite(1)

M: methyl chloride(2)

EO/$H_2SO_4$: ethylene oxide/$H_2SO_4$(3)

(1): Quaternisation in an alcoholic solution, 300 minutes at 80° C. Thereafter, careful removal of the alcohol by distillation.

(2): Quaternisation in an autoclave, after injection of methyl chloride 600 minutes at 130° C.

(3): Ethylene oxide passed into a solution of the starting product containing sulphuric acid.

Examples demonstrating that the acylated alkanolamines, in the molten state, can be used as solvents for the quaternisation are shown in Table 4.

TABLE 4

| Components | AB Q 1 | AB Q 2 | AB Q 3 | AB Q 4 | AB Q 5 |
|---|---|---|---|---|---|
| A 1 | 80 | | | | |
| A 2 | | 80 | | | |
| A 3 | | | 70 | | |
| A 4 | | | | 60 | 70 |
| B 1 | 20 | 20 | | | |
| B 2 | | | | | 30 |
| B 3 | | | 30 | | |
| B 4 | | | | 40 | |
| Quaternising agent | DMS | DMP | DMS | DMS | DMP |

The numbers indicated are percentages by weight. The quaternisations were carried out by using one mol of quaternising agent per mol of tertiary nitrogen group.

The reactions were carried out in the melt at 90°–100° C.

To prepare the textile-treatment agents according to the invention, the following components were mixed:

TABLE 5

| Components | T 1 | T 2 | T 3 | T 4 | T 5 | T 6 | T 7 | T 8 |
|---|---|---|---|---|---|---|---|---|
| A 1 | 72.0 | | | | | | | |
| A 2 | | 72.0 | | 72.0 | | | | |
| A 3 | | | 63.0 | | | | | |
| B 1 Q | 18.0 | 18.0 | | | | | | |
| B 2 Q | | | | 18.0 | | | | |
| B 4 Q | | | 27.0 | | | | | |
| AB Q 1 | | | | | 75.0 | | | |
| AB Q 2 | | | | | | 90.0 | | 72 |
| AB Q 4 | | | | | | | 85.0 | |
| Stearyl stearate(1) | 10.0 | 10.0 | | | | 10.0 | | 8 |
| Pentaerythritol tetrapelargonate | | | | 10.0 | | | | |
| i-Tridecyl stearate(3) | | | 10.0 | | | | 15.0 | |
| i-Octyl stearate(4) | | | | | 25.0 | | | |
| Polydimethylsiloxane emulsion mean viscosity 100,000 cSt | | | | | | | | 20 |

The numbers indicated are percentages by weight. The components are heated to 80° C. and stirred, and the resulting mixture is adjusted to 20% strength by adding warm water at 80° C. After stirring until homogeneous, the mixtures were cooled-down to room temperature while stirring. Liquid, cream-coloured formulations are formed which, by adding warm water, can be readily diluted to the concentration intended for use in practice.

(1): Rilanit STS-R ®, Messrs. Henkel, Dusseldorf (2): Emery 2485 ®, Messrs, Unilever-Emery, Gouda, Netherlands (3): Rilanit ITS ®, Messrs. Henkel, Dusseldorf (4): Rilanit EHS ®, Messrs. Henkel, Dusseldorf Sewability was tested by means of the following experimental procedure:

In a jet-dyeing apparatus, type "Labor-Jumbo-Jet" from Messrs Mathis, cotton interlock was reactively dyed with Levafix ® dyestuffs to give a black shade and then treated, after rinsing, for 20 minutes with products T 1 to T 8 of Table 5, in a liquor ratio of 1:10 at 40° C., acidified by means of acetic acid at pH 5. The concentration of the treatment agents was 4%, relative to the weight of material used.

In all 8 experiments, finishing was troublefree without troublesome foam formation or precipitations from the liquor.

One part of material was dried at 80° C., steamed twice for 10 seconds at 120° C. and conditioned at 23° C. and 65% relative humidity.

Another part of the finished material, after drying at 80° C., was steamed twice for 10 seconds at 120° C., then set for a further 20 seconds at 170° C. and then conditioned at 23° C. and 65% relative humidity.

In the sewing test, double layers of 35×80 cm fabric pieces were sewed without sewing thread by means of an industrial sewing machine of the Centurion 121 D 200 B type from Messrs. Singer, using a 90 gauge needle at 4,800 stitches per minute.

The fabric pieces were then clamped into a tensioning frame with an elongation of 88% and the number of burst loops over a stitching length of 80 cm was determined in transmitted light.

Table 6 shows the experimental data found in comparison to untreated material.

TABLE 6

| Product from Table 5 | Burst loops per 80 cm dried: Top layer | Burst loops per 80 cm dried: Bottom layer | Burst loops per 80 cm dried and set: Top layer | Burst loops per 80 cm dried and set: Bottom layer | Handle |
|---|---|---|---|---|---|
| T 1 | 4 | 3 | 5 | 3 | soft, silky |
| T 2 | 3 | 2 | 5 | 3 | soft, silky |
| T 3 | 3 | 2 | 6 | 2 | soft, smooth |
| T 4 | 4 | 1 | 4 | 3 | soft, smooth |
| T 5 | 3 | 3 | 4 | 4 | soft, smooth |
| T 6 | 4 | 2 | 5 | 3 | soft, silky |
| T 7 | 5 | 3 | 5 | 3 | soft, smooth |
| T 8 | 4 | 1 | 5 | 2 | soft, smooth |
| untreated | 38 | 21 | 40 | 31 | hard, rough |

Experiments under practical conditions

Product T 2 was used according to the following recipe:

Cotton interlock, reactively dyed black.

Jet-dyeing apparatus: "Surfer", Messrs. ESPA

Liquor ratio 1:12

Concentration 4% relative to weight of material 20 minutes at 40° C., pH 5 by means of acetic acid.

After centrifuging, the material dried at 80°–100° C. and steamed with saturated steam.

On sewing under practical conditions with an industrial sewing machine, 4,500–5,000 stitches per minute, 90 gauge needle, no burst loops were observed. The material had a pleasant, soft handle.

Product T 6 was applied according to the following recipe:

Cotton fine-rib, reactively dyed black

Jet-dyeing apparatus: "Jet R 95", Messrs. Thieβ

Liquor ratio 1:10

Concentration 4% relative to weight of material 20 minutes at 40° C., pH 5 by means of acetic acid After centrifuging and drying at 80°–100° C., the material was treated with saturated steam of 100°–110° C.

On sewing under practical conditions with an industrial sewing machine, 4,500–5,000 stitches per minute, 90 gauge needle, the material was free of burst loops. The goods had a pleasant, soft handle.

We claim:

1. Textile-treatment agents which contain

A. 50–80% by weight of acylated alkanolamines formed from saturated or unsaturated fatty acids having 12–22 C atoms and alkanolamines containing 1 or 2 nitrogen atoms, 1–3 hydroxyl groups and 2–6 C atoms, in a molar ratio of 1:1 to 3:1, B. 10–30% by weight of water-soluble quaternary ammonium salts of the general formula

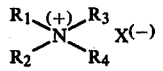

wherein $R_1$ denotes an alkyl or alkenyl radical having 14–25 C atoms which is interrupted by an amide or ester groups, $R_2$ denotes a radical such as $R_1$ or an alkyl radical having 1–4 C atoms, $R_3$ denotes an alkyl radical having 1–4 C atoms or an hydroxyethyl or hydroxypropyl radical, $R_4$ denotes an alkyl radical having 1–4 C atoms or an hydroxyethyl, hydroxypropyl or benzyl radical and $X^{(-)}$ denotes an anion, C. 2–20% by weight of a fatty acid ester formed from saturated or unsaturated fatty acids having 12–22 C atoms or dicarboxylic acids having 4–10 C atoms and monohydric to tetrahydric alcohols having 3–20 C atoms, D. 0–20% by weight of ethylene oxide adducts formed from fatty acids having 12–22 C atoms or from fatty alcohols having 8–18 C atoms or from alkylamines or dialkylamines having 12–36 C atoms or from alkylphenols having 10–24 C atoms and 3 to 50 mols of ethylene oxide and E. 0–25% by weight of diorganopolysiloxanes having a viscosity of 1,000 to 100,000 cSt.

2. Process for finishing natural and synthetic textile materials, comprising treating such materials with textile-treatment agents of claim 1.

3. Process according to claim 2, wherein finishing is carried out by means of aqueous formulations of the textile-treatment agents in an exhaustion process.

4. Process according to claim 2, wherein finishing is carried out by means of aqueous formulations of the textile-treatment agents in a dipping or spraying process.

5. Process according to claim 2, wherein finishing is carried out by means of aqueous formulations of the textile-treatment agents in an exhaustion process from short liquor by means of jet-dyeing units.

* * * * *